United States Patent [19]

Van Gompel

[11] Patent Number: 4,461,160

[45] Date of Patent: Jul. 24, 1984

[54] SELF-LATCHING, SEMI-AUTOMATIC DOOR LOCK AND OPENER

[75] Inventor: James Van Gompel, Fremont, Ind.

[73] Assignee: Brammall, Inc., Angola, Ind.

[21] Appl. No.: 199,945

[22] Filed: Oct. 23, 1980

Related U.S. Application Data

[62] Division of Ser. No. 035,685, May 3, 1979.

[51] Int. Cl.[3] ..... E05B 55/14; E05B 65/08; E05C 1/12

[52] U.S. Cl. ..... 70/100; 70/160; 292/38; 292/171

[58] Field of Search ..... 292/38, 36, 2, 167, 292/171, DIG. 60, DIG. 62, 163; 70/100, 158, 159, 160, 161, 99

[56] References Cited

U.S. PATENT DOCUMENTS

| | | | |
|---|---|---|---|
| 866,073 | 9/1907 | Saunders | 292/2 X |
| 1,282,787 | 10/1918 | Evans | 292/36 X |
| 1,628,473 | 5/1927 | Pokorney | 292/36 |
| 1,831,117 | 11/1931 | Huston | 292/38 X |
| 2,022,718 | 12/1935 | Heins | 292/38 |
| 2,140,621 | 12/1938 | Gerlach | 292/36 X |
| 2,153,916 | 4/1939 | Dunbar | 292/38 |
| 2,198,952 | 4/1940 | Sitko | 292/2 X |
| 2,548,242 | 4/1951 | Rosenbarger | 292/171 |
| 3,027,188 | 3/1962 | Eichstadt | 292/38 X |
| 3,543,441 | 12/1970 | LaPorte | 49/450 |
| 3,834,747 | 9/1974 | Slovensky, Jr. | 292/38 |
| 4,094,540 | 6/1978 | Roig | 292/38 X |

FOREIGN PATENT DOCUMENTS

| | | | |
|---|---|---|---|
| 781282 | 2/1935 | France | 292/2 |
| 810435 | 12/1936 | France | 292/36 |
| 908445 | 9/1945 | France | 292/38 |
| 137161 | 3/1930 | Switzerland | 292/36 |
| 12808 | 10/1908 | United Kingdom | 292/2 |
| 1424190 | 2/1976 | United Kingdom | 292/171 |

*Primary Examiner*—Robert L. Wolfe

[57] ABSTRACT

A lock mechanism is disclosed for use with sliding, swinging or overhead doors. A receiver is affixed to the door frame and a bolt, linkage and handle are affixed to the door. The linkage allows the bolt to engage the receiver by sliding along the receiver until it becomes latched so that the door may be closed though the handle is locked. Pulling upon the unlocked handle retracts the bolt from the receiver and also causes the door to start opening.

1 Claim, 23 Drawing Figures

Fig. 7
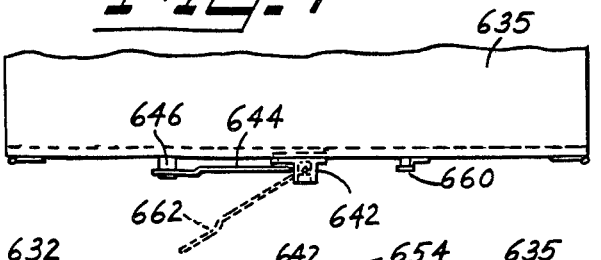
Fig. 8
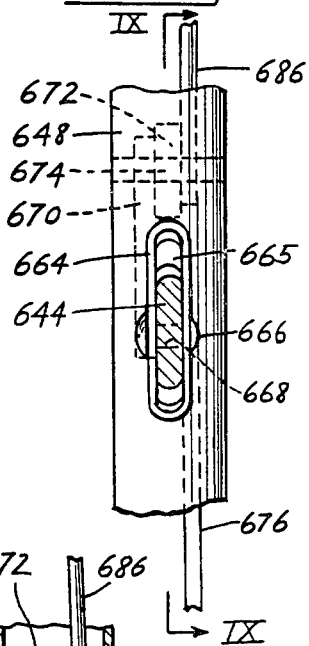
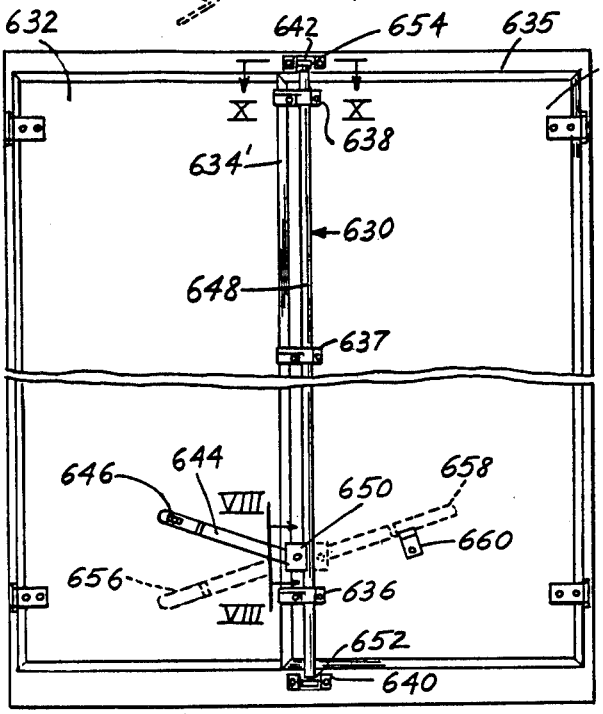
Fig. 6
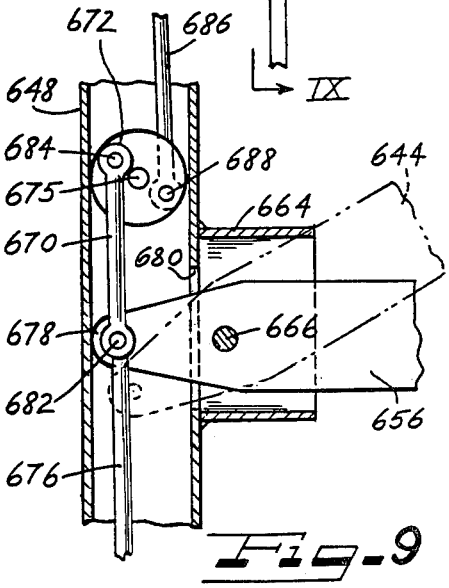
Fig. 9
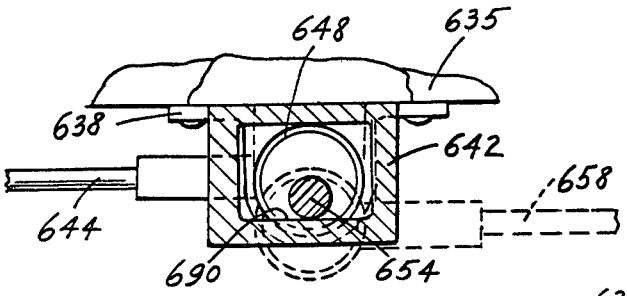
Fig. 10
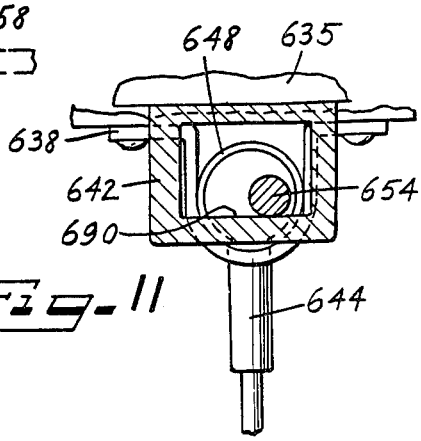
Fig. 11

SELF-LATCHING, SEMI-AUTOMATIC DOOR LOCK AND OPENER

This is a division, of application Ser. No. 035,685, filed May 3, 1979.

BACKGROUND OF THE INVENTION

The railroads are losing many doors off of box cars in switch yards, due to faulty hasps or latches or due to not latching the doors. The need has been expressed, for self-latching door hasps. Also, a need has been expressed for an intermediate height hasp which is not readily accessible to a thief operating from ground level.

A need also exists for a lock usable with swinging or overhead doors which may be locked while the door is open. When the door is slammed shut the spring-biased bolt latches it closed.

BRIEF SUMMARY OF THE INVENTION

The invention, an automatic self-latching hasp and semiautomatic door opener for use with sliding, swinging and overhead doors comprises:

(a) a spring biased bolt, (b) a handle pivotally mounted with respect to the spring biased bolt, (c) a linkage between the handle and the spring biased bolt, (d) a bolt receiver mounted on the stationary door frame, The spring biased bolt engages the stationary receiver to lock the door closed. The pivotally mounted handle is connected to the spring biased bolt with the linkage. As the handle is rotated, the spring biased bolt is retracted from the receiver and the door starts to move. Once the spring biased bolt has cleared the receiver, the handle may be relocked and the door opened completely. To lock the door it is only necessary that the door be slid or slammed shut. The linkage allows the bolt to engage the receiver without moving the handle thus locking the door closed.

BRIEF DESCRIPTION OF THE DRAWINGS

FIG. 6 is a front view of a latch system mounted on a swinging door;

FIG. 7 is a top view of a latch system mounted on a swinging door;

FIG. 8 is a side view of the intersection of the handle with the lock housing;

FIG. 9 is a partial section of a latch system showing the connection between the handle and the connecting rods;

FIG. 10 is a section through the receiver showing the spatial relationships between the handle, external housing and the bolt when the handle is in the open and the closed position;

FIG. 11 is a section through the receiver showing the spatial relationships between the receiver, the external housing and the handle when the handle is in an intermediate position;

DETAILED DESCRIPTION OF THE PREFERRED EMBODIMENTS

Figure 1:
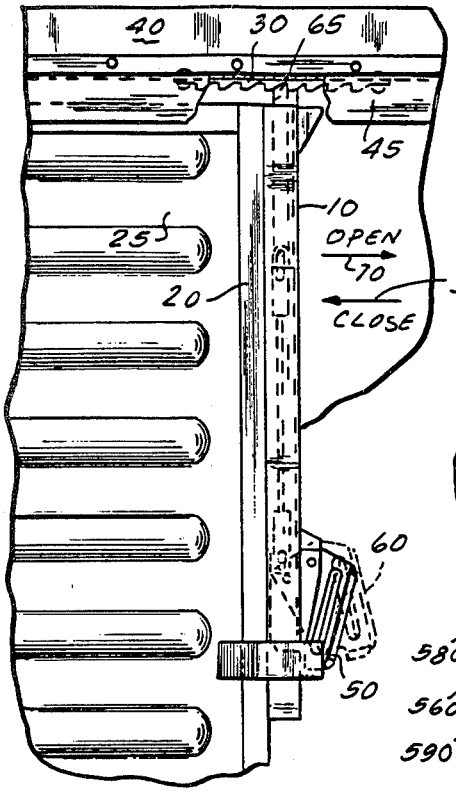
FIG. 1 is a front view of the latch system mounted on a box car door.

While the principles of the present invention find a particular utility in a self-latching, self-locking semi-automatic door lock, it will be understood that the principles of the present invention may be utilized in other combinations. By way of exemplary disclosure of the best mode of practicing the invention, there is shown generally in FIG. 1, one form of the present invention 10 mounted on an edge 20 of a box car door 25. A rack or receiver 30 is mounted inside the upper door rail 45. The box car door 25 is closed by pushing on the trailing edge of the door, causing it to glide in the direction of an arrow 55. The box car door 25 is opened by pulling on the handle, causing it to move to position 60, thereby retracting the latch bolt 65 from the rack 30 allowing the door 25 to move in the direction of the arrow 70. As can be noted from FIG. 1, the rack 30 and mating latch bolt 65 and handle 50 are located well above ground level out of tampering range. Further, the process of closing the door 25 does not require that the handle 50 be moved so that the handle 50 may be locked as disclosed below and the door 25 may still be closed later. A further advantage, apparent in FIG. 1, is that the latching system 10 and rack 30 may be easily installed on a box car door by means of a simple welding operation, even though the car may already be in service.

Figure 2:
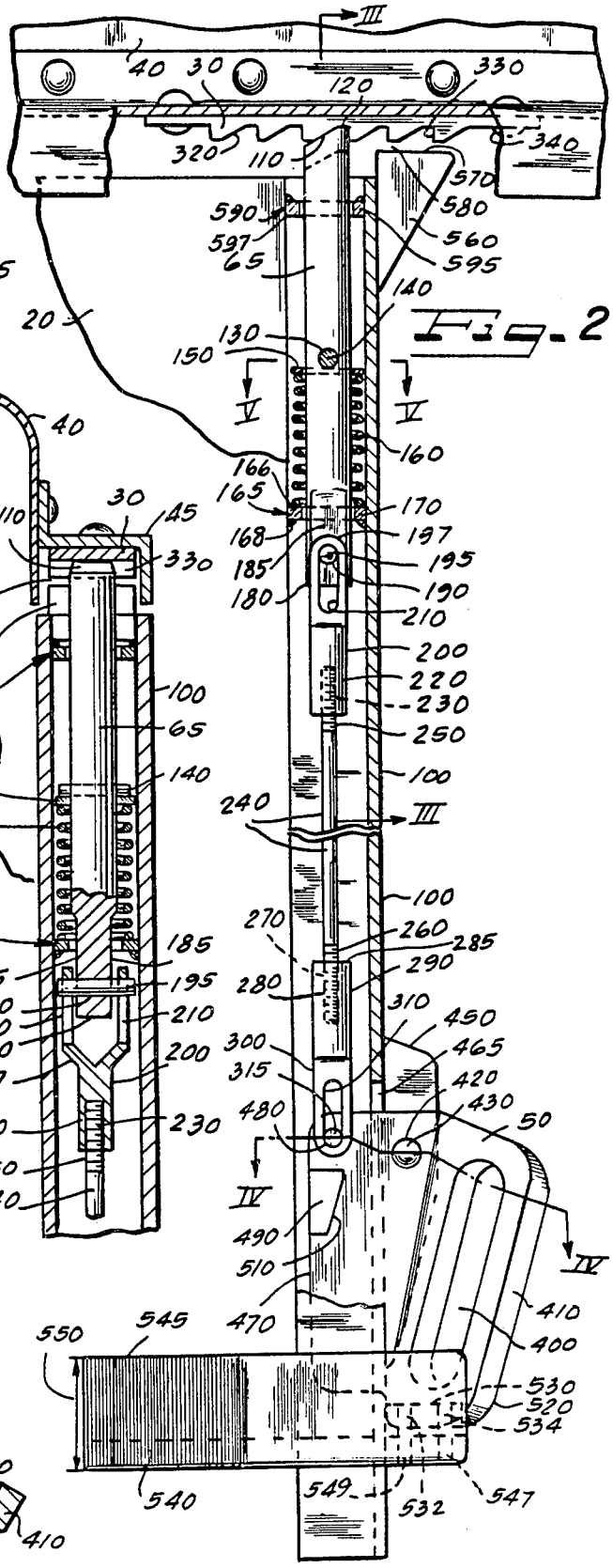
FIG. 2 is an enlarged section of the latch of FIG. 1.
Figure 5:
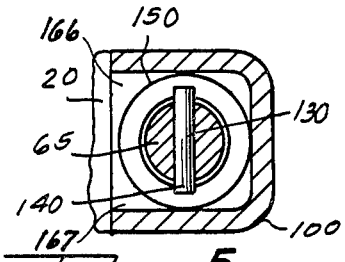
FIG. 5 is a section through the latching bolt showing the pin retaining the biasing spring taken along line V—V of FIG. 2.
Figure 4:
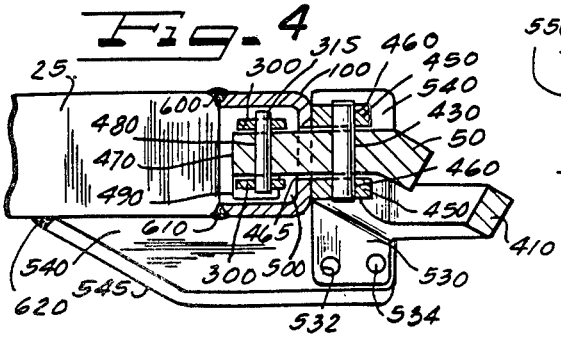
FIG. 4 is a section of the detail of the handle mechanism taken along the line IV—IV of FIG. 2.

FIG. 2 discloses the detailed construction of the latch system 10. FIGS. 4 and 5 disclose a U-shaped housing 100, which is welded to the back 20 of the box car door 25. The housing 100 contains the latch mechanism. The latch bolt 65 interior to the housing 100 has a beveled surface 110 and a surface 120 perpendicular to the axis of symmetry of the latch bolt at the top end of said latch bolt 65. Further down the latch bolt 65 there is a hole 130 through the axis of symmetry of the latch bolt 65 and perpendicular thereto wherein is mounted a retaining pin 140 which extends into the region on each side of the latch bolt 65 between said latch bolt and the external housing 100 (see FIG. 5).

Immediately below the retaining pin 140 and retained thereby is a spring biased washer 150. The washer 150 is biased by the cylindrical compression spring 160 through which passes the latch bolt 65. The lower end of the compression spring 160 is retained by a horseshoe shaped washer 165. The washer 165 is welded 168 to the housing 100. There is a similar bolt guide 590 welded near the top end of housing 100. The upward force exerted by the compression spring 160 against the pin 140, is adequate to drive the top end 110, 120 of the latch bolt 65 into the rack 30 so as to securely latch the door 25. Each side of the latch bolt 65, near the bottom end 180, has a machined flat 185.

Near the bottom end 180 is a hole 190 through which passes a pin 195 which supports a member 200 having a yoke 197. The yoke 197 has a slot 210 which allows the latch bolt 65 to move freely up and down as its top end 110, 120 engages and disengages the rack 30 without requiring the handle 50 to move, while the door 25 is being closed.

The lower end of the member 200 has a hole 220 with threads 230 into which is screwed the top end of the connecting bar 240. The top and bottom ends of the connecting bar 240 have threads 250 and 260 respectively. The threads 250 and 260 which engage threads 230 in the member 200 and a set of threads 270 cut into a hole 280 in a top end 285 of a connecting link 290 to allow the height of the latch bolt 65 to be finely adjusted before installation.

A lower end 300 of the connecting link 290 is likewise yoke shaped with a slot 310. The slot 310 functions the same way as does the slot 210 in that as the door 25 is being closed, the latch bolt 65 is able to freely engage and disengage the rack 30 without moving the handle 50 because the latch bolt 65 can freely travel in a vertical direction due to the fact that the slots 210 and 310 disengage the pin 195 and a pin 315 during the time that the latch bolt 65 is moving down due to sliding along a surface 320 of one of the latching teeth 330 on the rack 30.

The rack 30 is composed of a number of identical teeth of which the tooth 330 is typical with each having the typical surface 320 at an angle to the direction of the travel of the door 25 such that the surface 110 of the latch bolt 65 will slide or skid over the surface 320 as the door is being closed hence temporarily forcing latch bolt 65 down to clear the tooth 330. The angle of the surface 110 is also shallow enough so that the latch bolt 65 will slide over the rivet 340 as the door 25 is being closed.

A hole 400, large enough for a large hand in a heavy glove or mitten, is situated near the rear 410 of the handle 50. There is a hole 420 through which passes a pin 430 about which the handle 50 pivots when it is pulled into the position 60 to unlatch and open the door 25 (see FIG. 1). To support the pin 430 the housing 100 has a pair of ears 450 welded to it. Each of the ears 450 has a hole 460 through which the pin 430 passes. To provide access to the latch mechanism, the housing 100 has a slot 465 cut into it at the lower end through which a front end 470 of the handle 50 extends. It is in the front end 470 of the handle 50 that there is a hole 480 through which the pin 315 passes. Welded to the front end 470 of the handle 50 is a stop 490 which engages the surface 500 of the housing 100 (see FIG. 4). As the handle 50 is pulled into position 60 (FIG. 1) to release the bolt latch 65 and start the door 25 moving in the direction 70, the surface 510 of the stop 490 engages the surface 500 (FIG. 4) of the housing 100 and prevents further travel of the handle 50.

A lower portion 520 of the handle 50 has welded to it a plate 530 rectangular in shape. The plate 530 has two holes 532 and 534 through which locking devices may be installed. In the vicinity of the handle 50 an anchor plate 540 is welded to the box car door 25 on installation. The anchor plate 540 in turn supports a rectangular skid plate 545 which is also welded to the anchor plate 540 and the box car door 25. The anchor plate 540 and skid plate 545 protect the handle 50 and the plate 530 from damage due to careless driving of fork lifts or towmotors. The skid plate 545 may have any desired height 550. Two holes 547, 549 pass through the plate 540 and line up respectively with the holes 534 and 532 so that a locking device may be inserted through these holes to keep the handle 50 locked.

To the top of the housing 100 is welded a triangular shaped block 560 which serves to make the latch bolt 65 more theft resistant. An upper surface 570 of the block 560 is in close proximity to the rack 30 so that it will be very difficult to gain access to the latch bolt 65 through the space 580.

Figure 3:
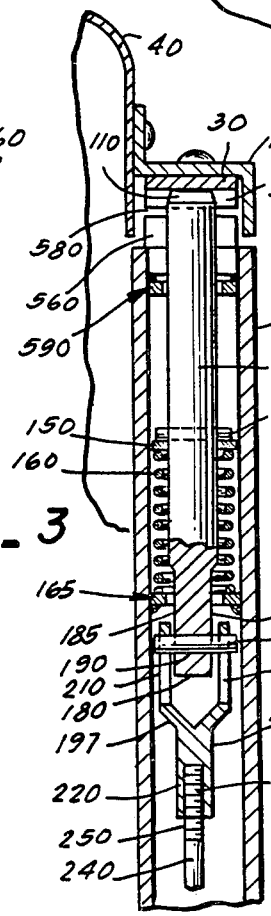
FIG. 3 is a partial section of the bolt mechanism taken along the line III—III of FIG. 2.

At the top of FIG. 3, the roof 40 of the box car joins the upper door rail 45 wherein is mounted the rack or engaging bar 30. The typical tooth 330 of the rack 30 is shown behind the beveled surface 110 of the latch bolt 65. The triangular protection plate 560 appears behind the housing 100 and the narrow space 580 between the plate 560 and the teeth 330 of the rack 30 is made clear. The two guides 590 and 165 which keep the latch bolt 65 vertical in the housing 100 are shown behind the latch bolt 65. The pin 140 which retains the spring biased washer 150 is shown in relationship to the spring 160. The two flats 185 machined into the latch bolt 65 so that the pin 195 passing through the hole 190 will properly support the yoke 197 within the housing 100 are also shown. The yoke 197 of the member 200 has the slots 210 as were originally shown in FIG. 2.

FIG. 4 shows that the rear 410 of the handle 50 allows finger clearance due to the angle at which the handle 50 is set with respect to the box car door 25. The two ears 450 which are welded onto the housing 100 and which support the pin 430 are clearly shown in FIG. 4. Also, FIG. 4 shows the slot 465 in the housing 100 through which the handle 50 extends to connect with the member 290 via the yoke 300 and engaging pin 315. The stop 490 welded to the front 470 of the handle 50 and the mating surface 500 on the interior housing 100 are also shown in FIG. 4.

FIG. 4 discloses a pair of welding points 600, 610 whereby the housing 100 is affixed to the rear 20 of the box car door 25, and a welding point 620 whereby the anchor plate 540 and skid plates 545 are affixed to the rear 20 of the box car door 25.

FIG. 5 discloses the retaining pin 140 which passes through the hole 130 in the latch bolt 65 and against which the spring biased washer 150 presses.

The principles of the present invention may be utilized on other types of doors other than sliding doors as above enumerated. FIG. 6 discloses the self-latching, semi-automatic door opener of the present invention with a concealed shackle installed on the handle of the swinging doors at the back of a semi-trailer truck. A lock mechanism 630 is mounted so as to lock a pair of swinging doors 632 and 634 which are mounted on the back of a trailer 635. The door 634 has a weather strip 634' which overlaps the door 632. The lock mechanism 630 is retained in position against the door 634 by a set of brackets 636, 637 and 638 which permit the lock 630 to rotate. The brackets 636, 637 and 638 also overlap the door 632 for additional security. A pair of receivers 640 and 642 mounted on the back of the trailer 634 engage the lock mechanism 630 and enable the lock mechanism 630 to lock the doors 632 and 634 closed.

The lock mechanism 630 consists of a handle 644 containing a lock 646, a cylindrical external housing 648, and a junction 650 where the handle 644 joins the external housing 648. A pair of locking bolts 652 and 654 engage the pair of receivers 640 and 642. The handle 644 is shown in the locked position. The process of unlocking the door consists of inserting and turning a key into the lock 646 which releases it from the concealed shackle in the door 632. Moving the handle 644 downwardly into a position 656 and rotating the handle 644 to a position 658 brings it to rest on the bracket 660 affixed to the door 634. At this point the lock mechanism 630 has been rotated and unlatched. The doors 634 and 632 respectively may now be opened.

FIG. 7, a view from the top of the trailer 635, discloses the handle 644 and the lock 646 locked to the door 632. An intermediate position of the handle 644 is shown at 662 wherein the handle 644 has partly rotated away from the door 632. As the handle 644 is rotated from the door 632 to a position 658 as in FIG. 6, against the bracket 660, the cylindrical housing 648 is also rotated, as in FIG. 10.

FIG. 8 is a side view of the junction 650 where the handle 644 intersects the external housing 648. The handle 644 is received into a hollow bracket 664 through an opening 665. The handle 644 pivots about a rivet 666 which passes through the handle 644 in a body hole 668. The handle 644 is connected to a connecting rod 670. The connecting rod 670 is pivotably connected to a bell crank 672, as in FIG. 9, which rotates around a center of rotation 674 on a pin 675. A second connecting rod 676 is connected to an extension of the handle 644 and the lower latching bolt 652. The travel of the handle 644 between the latched position against the door 632 and the position 656 where the bolts 652 and 654 are retracted, can be altered by changing the distance between the pivot point 666 of the handle 644 and the length of each of the connecting rods 670 and 676.

Another view of the junction point 650 is disclosed in FIG. 9. FIG. 9 shows the handle 644 in the unlatched position 656. The handle 644 has been rotated around the pivot point 666 and an extension 678 of the handle 644 extends into the external housing 648 through an opening 680 between the housing 648 and the bracket 664. Near the end of the extension 678 is a pivot point 682 to which are connected the connecting rod 670 and the connecting rod 676. The bell crank 672 is connected to the cylindrical housing 648 by a shaft 675. The connecting rod 670 is pivotably connected to the bell crank 672 at a connecting point 684. A third connecting rod 686 which is connected to the upper latching bolt 654, which engages the receiver 642, is connected to the bell crank 672 at a pivot point 688.

FIG. 10 illustrates some of the spatial relationships between lock 630 and the rear 635 of the trailer. When the handle 644 is in the locked position the latching bolt 654 bears against an inside edge 690 of the receiver 642. As can be noted from FIG. 10, the latching bolt 654 is positioned off-center with respect to the cylindrical external housing 648. The off-center positioning causes the latching bolt 654 to act like a cam when the external housing 648 is rotated such that the handle 644 no longer is in the locked position but assumes the unlocked position 658. When the handle 644 is moved from the unlocked position 658 into the locked position against the door 632, the rotation of the cylindrical external housing 648 around the latching bolt 654 moves the door 632 and the door 634 inward by an amount proportioned to twice the distance between the center of the latching bolt 654 and the center of the external cylindrical housing 648.

FIG. 11 shows the handle 644 in an intermediate position between the fully closed and the fully opened positions. It also illustrates the lateral movement of the latching bolt 654 with respect to the surface 690 of the receiver 642 as the handle 644 goes from the fully opened to the fully closed position.

Figure 12:
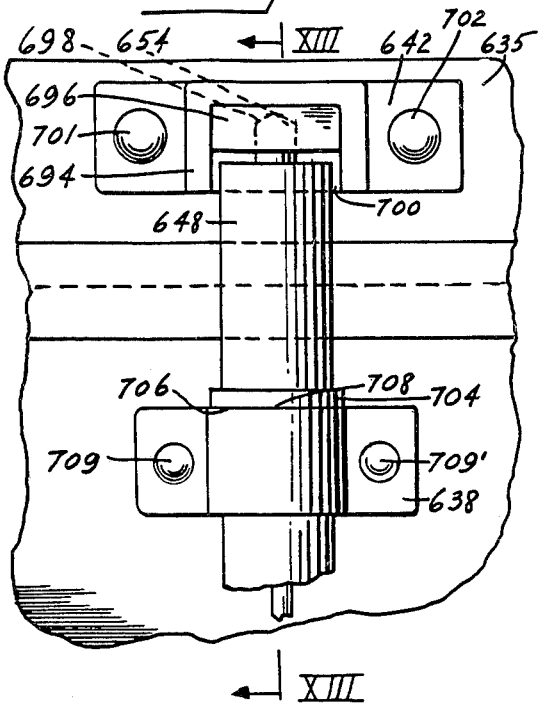
FIG. 12 is a view of the receiver and bolt when the door is locked shut.
Figure 13:
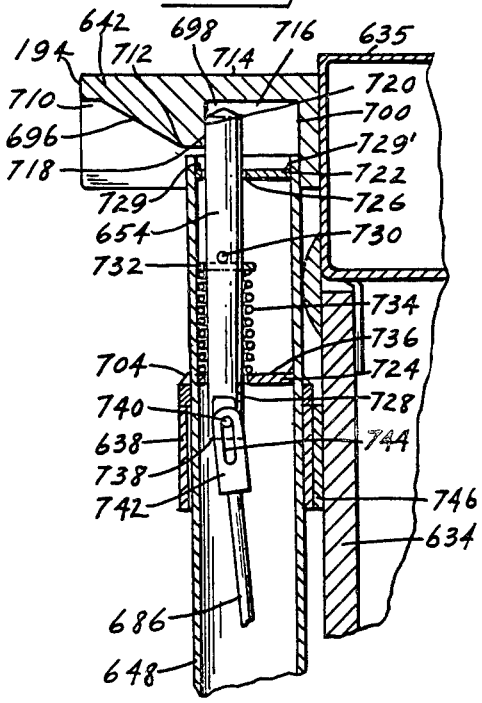
FIG. 13 is a partial section, taken along line XIII—XIII of FIG. 12, showing the details of the assembled bolt.

In another embodiment, FIGS. 12 and 13 disclose the details of the latching bolt 654 and the receiver 642. These are identical for both the bolts 654, 652 and the receivers 640 and 642 so one description will suffice for both. The receiver 642 has a three sided front surface 694 which is generally of a rectangular shape. An interior ramp 696 resides within the front surface 694 of the housing 642. The purpose of the ramp 696 is to depress the bolt 654 by applying a force to a top surface 698 of the bolt 654 as the door 634 is being closed against the back 635 of the trailer. The receiver 642 has a rear surface 700 which provides a stop for the housing 648 of the lock 630. The receiver 642 is held to the back of the trailer 635 by a pair of rivets 701 and 702. The rotary housing 648 is supported by a cylindrical collar 704 which is an integral part of the housing 648. A lower surface 706 of the cylindrical collar 704 bears against an upper surface 708 of the clamp 638 whose function is to hold the lock 730 against the door 634. The clamp 638 having the surface 708 is such that the housing 648 can rotate by means of the collar 704 on the surface 708. The clamp 638 is held against the door 634 by a pair of rivets 709, 709'.

FIG. 13, a section of the detail shown in FIG. 12, discloses the ramp 696 of the receiver 642. The ramp 696 terminates in a first flat surface 710 and a second flat surface 712 both of which are essentially parallel to a top surface 714 of the receiver 642. The front edge 694 of the receiver 642 is perpendicular thereto. The bolt 654 with the top surface 698, which first bears against the surface 710, glides down the ramp 696, bears against the surface 712 and then enters a recess 716 interior to the receiver 642 and behind the ramp 696. When a surface 718 of the bolt 654 bears against a surface 720 of the rectangularly shaped recess 716 the bolt 654 is in the latched position. The bolt 654 is positioned radially with respect to the housing 648 by a pair of supporting plates 722 and 724 each having an off-center boring 726 and 728 therethrough. The plates 722, 724 are welded to the housing 648 at example points 729 and 729'. The bolt 654 further contains a transverse pin 730, a washer 732 and a coil spring 734. The coil spring 734 bears against a top surface 736 of the plate 724 and also against the washer 732 which in turn bears against the transverse pin 730 thereby providing a spring bias to the bolt 654. A lower end 738 of the bolt 654 contains a second transverse pin 740 which engages a yoke 742 threadably attached to the connecting rod 686. The yoke 742 has a rectangular shape with an interior region 744 as discussed previously such that the lock 630 may be relocked once the door 734 has been reopened, then the door may be slammed closed with the bolts 654 and 652 riding up the ramps corresponding to the ramp 696 in each of the receivers 740 and 742 so that the door will be locked. The rotary coupling 638 is shown separated from the rear door 634 by a spacer 746.

Figure 14:
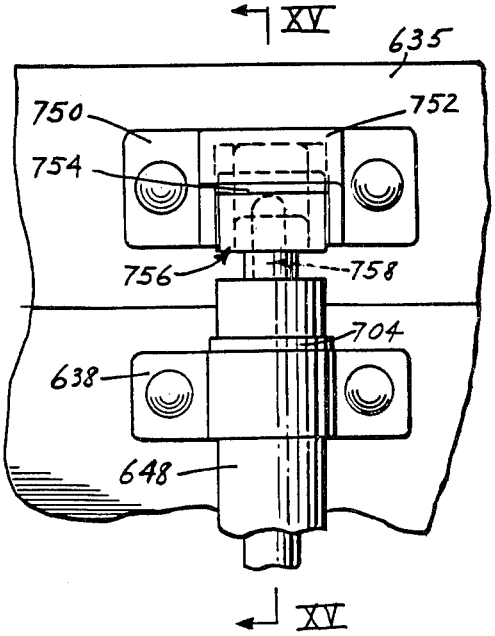
FIG. 14 is a view of an alternate receiver and bolt when the door is locked shut.
Figure 15:
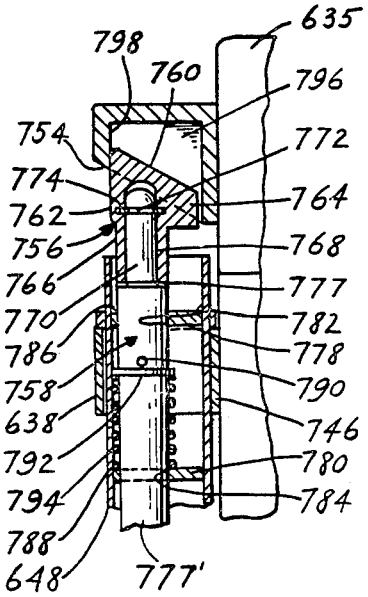
FIG. 15 is a partial section, taken along line XV—XV of FIG. 14, showing the details of the assembled alternate bolt and receiver.

An alternate receiver 750 is disclosed in FIGS. 14 and 15. The receiver 750 has a front surface 752 of a substantially rectangular shape which in turn has a three sided biased edge 754 against which bears a cap 756 on top of an alternate latching bolt 758. With respect to FIG. 15, the cap 756 has a top bias surface 760 and two parallel edges 762 and 764 which intersect the top bias surface 760. The cap 756 also has a sleeve 766 which has an interior cylindrical region 768 into which a top portion 770 of the bolt mechanism 758 is inserted. The top portion 770 of the bolt mechanism 758 is held within the cylindrical boring 768 by a slot 772 which retains a snap ring 774 which engages a lip 776 interior to the cylindrical boring 768 of the cap 756. The top portion 770 of the bolt 758 terminates in a shoulder 777.

A body 777' of the bolt 758 is positioned radially with respect to the housing 748 by a pair of plates 778 and 780 each of which has an off-center cylindrical boring 782 and 784. The bolt mechanism 758 passes through the cylindrical borings 782 and 784. The plates 778 and 780 are attached to the housing 648 by a continuous weld 786. The bolt 758 further contains a transverse pin 790, a washer 792 and a compression spring 794. The compression spring 794 bears against the washer 792 and the lower plate 780 to provide a spring bias to the bolt 758 such that when the cap 756 having a surface 760 which slides along the biased surface 754 and which then engages a locking recess 796 interior to the receiver 750, the spring biasing due to the compression spring 794 drives the housing 756 into the region 796 wherein the surface 672 bears against an interior surface 798 of the receiver 750 thereby latching the door shut.

The principles of the present invention, a self-latching, self-locking, concealed shackle lock are also usable with an overhead door system.

Figures 16, 17, 18, 19, 20:
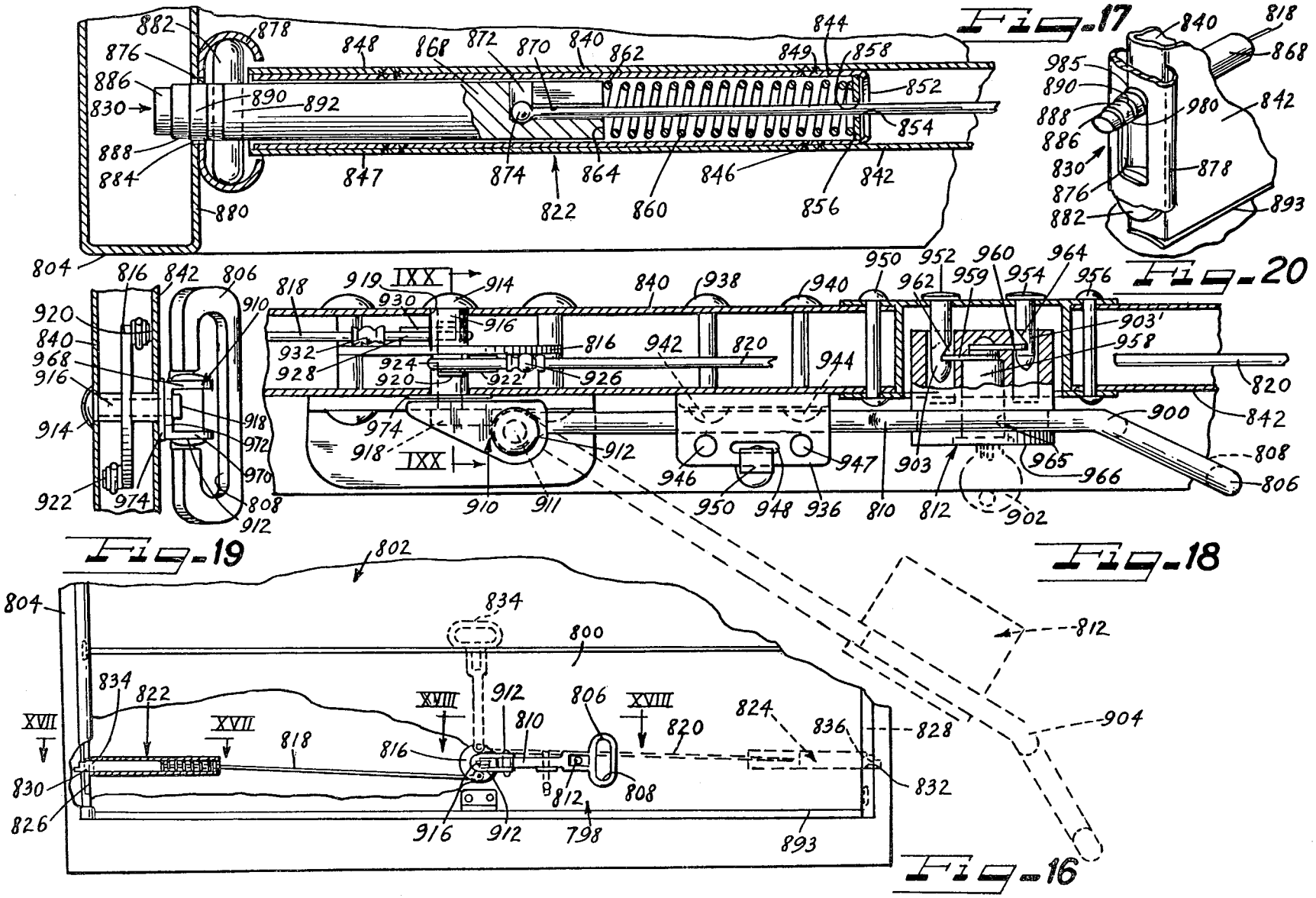
FIG. 16 is a front view of a latch system mounted on an overhead door.
FIG. 17 is a partial enlarged section taken along line XVII—XVII of FIG. 16, showing the details of the bolt mechanism.
FIG. 18 is a partial enlarged section, taken along line XVIII—XVIII of FIG. 16, showing the details of the handle mechanism.
FIG. 19 is a partial enlarged section, taken along line IXX—IXX showing the spatial relationship between the handle and the bell crank.
FIG. 20 is a partial end view of a bolt engaging the slot in the door track.

FIG. 16 discloses a lock mechanism 798 installed on a lower panel 800 of a vertical door 802 on the back of a truck 804. The lock mechanism 798 has an external handle 806 with a grasping boring therethrough 808. A shank 810 contains a lock 812 which locks the handle 806 against the lower door panel 800. A bell crank 816 is connected to the shank 810 of the handle 806. A pair of connecting rods 818 and 820 are pivotably connected to the bell crank 816. A pair of latching bolts 822 and 824 are connected to the connecting rods 818 and 820, respectively. A pair of tracks 826 and 828 are mounted on the rear of the truck 804. Each of the tracks 826 and 828 contain borings 830 and 831, respectively, into which a set of ends 834 and 836, respectively, of the bolts 822 and 824 are engaged so as to latch the door 802 in the down position.

An unlocking operation consists of the operator or driver inserting a key into the lock 812, and unlocking it. The key is then removed from the lock 812 and the handle 806 is pulled outwardly and moved from the latched position 90° to an unlatched position 834. The result of moving the handle 806 into the unlatching position 834 is to pull each of the connecting cables 818 and 820 toward the bell crank 816. As a result of the cables 818 and 820 being pulled toward the bell crank 816, the ends 834 and 836 of the bolts 822 and 824, respectively, are retracted from the boring 830 and 832 in the tracks 826 and 828 of the back 804 of the truck. Once the bolts 822 and 824 are retracted, the door 802 can be raised. As soon as the door 802 rises slightly. the handle 806 may be returned from its vertical position 834 to its normally locked position by moving it 90° in a clockwise direction. The lock 812 may be relocked thus rendering the handle 806 immovable. At this point the bolts 822 and 824 are being held in a depressed position against the inside walls of the channels 826 and 828. The door 802 may now be pushed to its fully opened position. To close the door it is merely necessary to grasp the handle 806, pulling the door downward until the depressed bolts 834 and 836 find their respective holes 830 and 832. By stepping on the toe plate 915 a greater degree of engagement may be attained since the bolts are stepped to account for normal compression of the weather seal 893 at door bottom.

FIG. 17 illustrates the details of the spring biased bolt mechanism 822. The lower panel 800 of the door 802 has an interior surface 840 and an exterior surface 842. A housing 844 for the bolt mechanism 822 is positioned between the interior wall 840 and the exterior wall 842 of the door 802. The housing 844 is held in position with respect to the interior and external walls 840 and 842 by a set of spot welds 846, 847, 848 and 849. The housing 844 has an end 852 crimped over a washer 856 with a boring 858 through which the cable 818 passes. A cylindrical spring 860 is positioned with one end adjacent to the washer 856 and a second end 862 adjacent to an end 864 of the bolt 868. The bolt 868 contains a boring 870 which starts at the end 864 and terminates at a transverse boring 872. The cable 818 is held in position by means of a ball 874 crimped thereon which is positioned in the boring 872 of the bolt 868. The ball 874 has a diameter such that it will not pass through the boring 870 of the bolt 868. Any other conventional method of securing a cable to the bolt 868 would be acceptable.

The end 830 of the bolt 868 passes through a hole 876 in a track 878. The track 878 is affixed to a side surface 880 of the rear frame 804 of the track. The track 878 is utilized for guiding the door 802 by means of a set of wheels such as the representative wheel 882 affixed to the door 802. The end 830 of the bolt 868 also passes through a second hole 884 through the surface 880 of the back of the track 804.

The end 830 of the bolt 868 consists of a series of steps 886, 888, 890 and 892. The steps 886, 888, 890 and 892 provide a series of latching positions depending on how far down the door 802 has been lowered and how much a weather strip 893 has been compressed. The steps 886, 887, 890 and 892 provide bearing surfaces which bear against the slots 884 and 876 when the bolts 868 is in the latched position.

FIG. 20 is a view showing the end 830 of the bolt assembly 822 with the stepped ends 886, 888 and 890 extending through the slot 876 of the track 878 when the door 802 is in the closed position.

FIG. 18 illustrates the details of the handle 806. The handle 806 joins the shank 810 at a point 900. The handle 806 is at a convenient angle with respect to the shank 810 so that the driver may readily grasp the handle 806, insert a key 902 into the lock shackle 812, rotate the key 902 to unlock a pair of shackles 903 and 903' and then pull the handle 806 forward to a position 904. The shank 810 is rotatably connected to a pivotal yoke 910. The shank 810 has a body hole 911 corresponding to a hole in the yoke 910 through which a pivot bolt 912 is inserted. The yoke 910 is rotatably connected to a central pivot bolt 914 with a body 916 and which has a rectangularly shaped head 918 within the flange 912. The rivet or bolt 914 passes through a body hole 919 in the interior skin 840 of the door 802. The body 916 of the bolt 914 is connected to the center of rotation of the bell crank 816.

When the handle 806 is pulled into the position 904 after it has been unlocked, and then rotated 90° counterclockwise to the position 834, the triangularly shaped flange 910 and pivot bolt 914 also rotate the same 90°. Since the body 916 of the bolt 914 also rotates 90°, the bell crank 816 also rotates 90°. Affixed to the bell crank 816 is an additional pair of pins 920 and 922. The cable 820 rides in a thimble 922' to form a loop 924 which is clamped by a crimp 926. The thimble 922' is to avoid wear on the cable 820. The cable 818 is similarly affixed to the pin 922. A loop 928 rides in a thimble 930 to minimize wear and is clamped by a crimp strip 932. As the bolt 914 is rotated, it rotates the bell crank 816 which in turn applies tension to the two cables 818 and 820 to retract the bolts 822 and 824.

A channel member 936 is affixed to the exterior surface 842 of the panel 800 receives the shank 810 of the handle 806. The channel guide 936 is affixed to the exterior surface 842 by a pair of rivets 938 and 940 which terminate in heads 942 and 944 which are interior to the U-shaped guide 936 and protected from tampering when handle 806 is locked. The purpose of the channel is to guide the lock 812 onto the shackles 903 and 903' accurately every time.

Circular holes 946 and 947 and a rectangular slot 948 are provided on the U-shaped guide 936 for installation of a seal 950.

It should be noted that the head 918 of the central pivot bolt 914 resides within the triangular shaped flange 912 and is protected thereby from attack by a chisel or other opening tool. The additional rivets such as the rivets 950, 952, 954, and 956 are all protected by the shank 810 of the handle 806 when the handle is in the locked position.

The lock 812 comprises a cylinder 958 having a pair of flanges 959 and 960 which engage a set of notches 962 and 964 of the shackels 903 and 903' which have a pair of heads 952 and 954, respectively. The cylinder 958 is mounted in a boring 965 in a lockplate 966 affixed to the shank 810.

FIG. 19 illustrates the detail of the central pivolt bolt 914. The head 918 of the central pivot bolt 914 with the body 916 is contained and protected within the triangular yoke 910 having a pair of parallel surfaces 968 and 970 which are connected to a rear surface 972 adjacent to a washer 974. The bolt 912 is also illustrated which is the bolt about which the shank 810 rotates at the pivot point 910.

Figure 21:
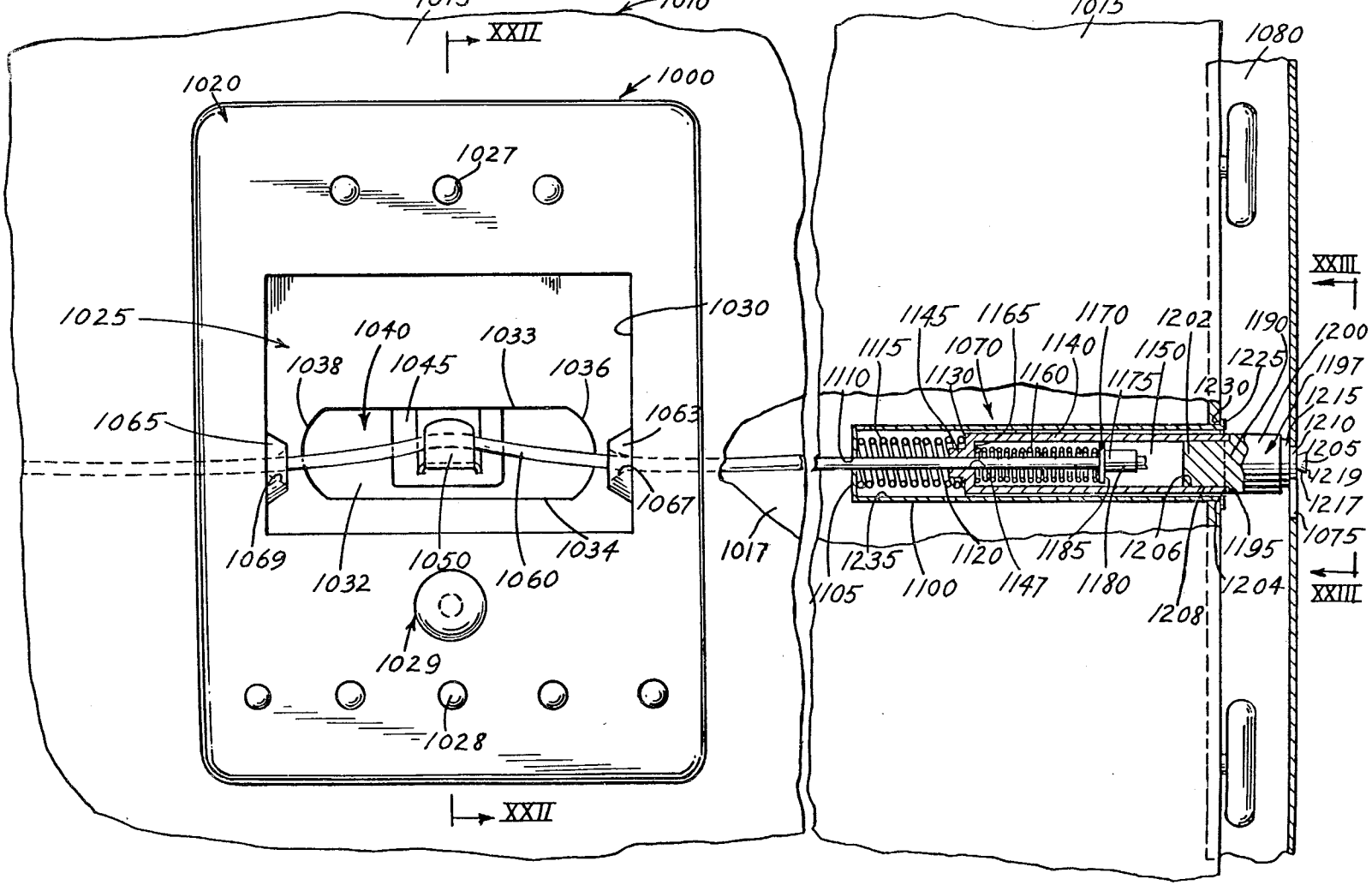
FIG. 21 is a partial broken away view of a variation on an overhead door lock from the inside of a truck.

A variation on the overhead door lock mechanism is disclosed in FIG. 21. A lock 1000 is mounted on an overhead door 1010 having an inside surface 1015. The lock 1000 has an interior section 1020 and an exterior section 1025. The interior section 1020 and the exterior section 1025 are retained in position with respect to the door 1010 by a set of rivets such as the rivets 1027 and 1028. A concealed shackle 1029 is mounted through the rear surface 1015. The interior section 1020 has a rectangular hole 1030 therein. The exterior section 1025 has a rectangular shaped hole 1032 therein consisting of a pair of straight parallel sides 1033 and 1034 and a pair of curved edges 1036 and 1038 which intersect the parallel straight edges 1033 and 1034. Affixed to the exterior portion 1025 of the lock 1000 is a handle 1040. Affixed to the handle 1040 is a plate 1045 containing a hook-shaped member 1050 having a gusset 1051. The hook-shaped member 1050 retains a cable 1060. The cable 1060 passes through a pair of wear bushings 1063, 1065 having central borings 1067 and 1069. The cable 1060 is connected to a pair of bolt mechanisms of which a typical one 1070 is illustrated. The typical bolt mechanism 1070 engages a slot or hole 1075 in a track 1080 on which the door 1010 rides up and down. The door 1010 would normally have two tracks one on each side of which the track 1080 is typical.

The bolt mechanism 1070 comprises a housing 1100 having an end 1105 with a centered boring 1110 therethrough. Within the housing 1100 is an interior region 1115 containing a large compression spring 1120 which bears against the end 1105 and against a shoulder 1130 of a hollow bolt 1140. The large spring 1120 is kept centered with respect to the shoulder 1130 by a cylindrical extension 1145. The extension 1145 of the bolt 1130 has a centered boring 1147 therethrough and in an interior cavity 1150 contains a second, small spring 1160. The spring 1160 bears on an interior end 1165 of the hollow bolt 1140 and against a washer 1170. The cable 1060 extends through the boring 1110 in the housing 1100, and through the boring 1147, through the extension 1145 of the hollow bolt 1140. The cable 1060 also extends through a hole 1175 through the center of the washer 1170 and is crimped by a crimp band 1180. The crimp band 1180 bears against a surface 1185 of the washer 1170. The hollow bolt 1140 has an end 1190 which is bounded by an edge 1195. A solid bolt-end 1197 closes the end 1190 of the bolt 1140. The bolt-end 1197 has a body portion 1200 which has a smaller diameter end 1202 separated from the body portion 1200 by a shoulder 1204. The shoulder 1204 mates with the external surface 1195 to properly position the bolt-end 1197 with respect to the hollow bolt 1140. An interior surface 1206 of the hollow bolt 1140 mates with an exterior surface 1208 to retain the bolt-end 1197 within the bolt 1140.

Figure 23:
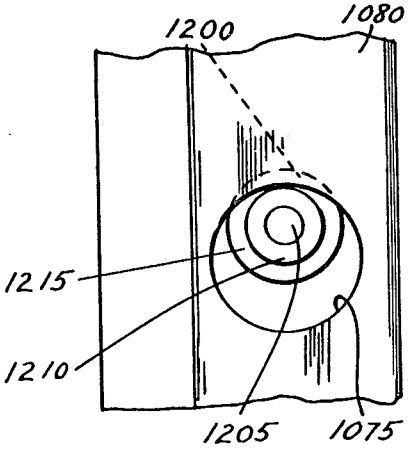
FIG. 23 is an end view of a bolt engaging the hole in the door track.

The bolt-end 1197 has an end which engages the hole or slot 1075 which consists of a set of stepped edges 1205, 1210 and 1215. As can be seen in FIG. 23, the stepped edges 1205, 1210 and 1215 are cylindrical. The sides of the stepped edges 1205, 1210 and 1215, such as a side 1217, are not perpendicular to a front surface 1219 of the stepped edge 1205 but are at an angle with respect to the surface 1205 which is less than 90°. The biased sides of the steppededges 1205, 1210 and 1215 such as the typical side 1217 minimize the probability of the bolt-end 1197 becoming disengaged from the hole or slot 1075 due to vibration.

In FIG. 21 the bolt housing 1100 has a flange 1225 which bears against an edge 1230 of the door 1010 to keep the bolt mechanism 1070 properly positioned in a space 1235 between the exterior surface 1017 and the interior surface 1015 of the door 1010.

Figure 22:
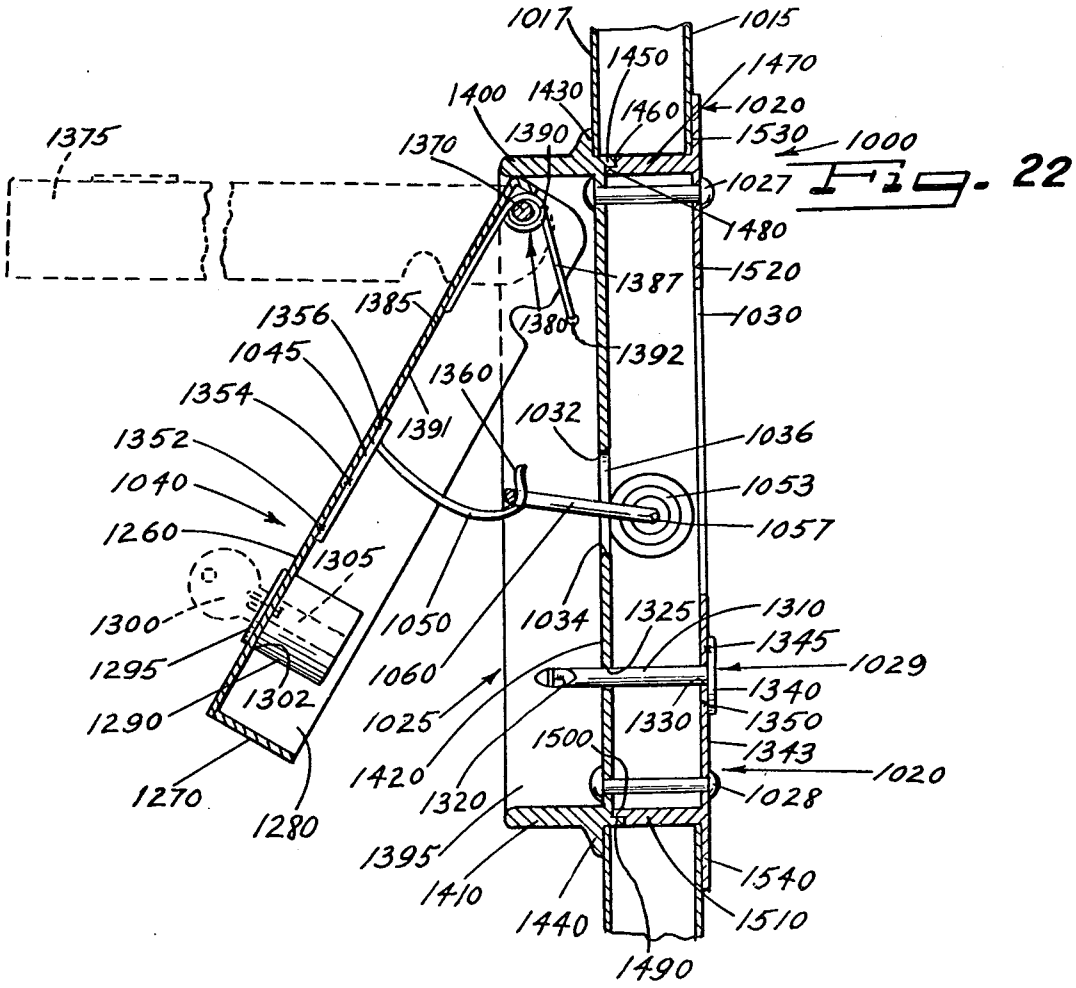
FIG. 22 is a partial enlarged section, taken along line XXII—XXII of FIG. 21, showing the details of the overhead door handle.

FIG. 22 discloses the details of a handle 1040 affixed to the exterior section 1025 of the lock 1000. The handle 1040 comprises a front side 1260. A side member 1280 is perpendicular to the front side 1260. A bottom member 1270 is perpendicular to both the front side 1260 and the side member 1280. A lock 1290 having a front surface 1295 into which a key 1300 may be inserted passes through a hole 1302 in the front side 1260. The lock 1290 contains an internal boring 1305 of a conventional variety which engages a shaft 1310 on the shackle 1029 having a notched end 1320 for locking the handle 1040 closed. The shaft 1310 extends through a pair of holes 1325 and 1330 in the exterior section 1025 and the interior section 1020 of the lock 1000, respectively. The shackle 1029 has a head 1340 which is positioned adjacent to the surface 1343. A pair of spot welds 1345 and 1350 retains the head 1340 of the shackle 1029 against the surface 1343.

The handle 1040 also supports the plate 1045 and has a set of spot welds 1352, 1354, and 1356 which retains the plate 1045. The hook 1050 retains the cable 1060 by means of a curved interior surface 1360. The handle 1040 pivots about a shaft 1370 and is biased so as to assume a position 1376 by means of a torsion spring 1380 when key is turned. The torsion spring 1380 has a first arm 1385, a second arm 1387 and a coil 1390 positioned about the shaft 1370. The arm 1385 bears against the surface 1391 of the handle 1040. The second arm 1387 engages a boring 1392 in a side member 1395 of the external portion 1025 of the lock 1000. The action of the coil 1390 spreading apart the arms 1385 and 1387 tends to bias the handle 1040 outwardly to the position 1376 so as to cause the hook 1050 to draw up the slack in the cable 1360, through the bushings 1063 and 1065. Retraction of the bolt 1140 is accomplished by lifting the handle 1040 to a farther open position in the approximate position 1375.

As the handle 1040 is lifted to its open position 1375, the cable 1060 retracts the bolt 1140 from the hole 1075 in the track 1080. The small spring 1160 is compressed first. After the small spring 1160 is fully compressed, the large spring 1120 is then compressed. When the large spring 1120 has been compressed adequately, the bolt-end 1197 of the bolt 1140 is retracted from the hole 1075 in the track 1080. The door 1070 is then unlatched and may be raised. The operator would stop the door approximately half way up, remove the key 1300 and swing the handle 1040 back into the locked position. The shackel 1310 with the end 1320 would then enter the boring 1305 in the lock 1290 and lock the handle 1040 closed. The door 1010 can then be opened the rest of the way. To latch the door 1010 it is only necessary to lower it so that the bolt-end 1197 engages the receiver hole 1075 due to the biasing effect of the large spring 1120. Because of the steps 1205, 1210 and 1215, the bolt-end 1197 can engage the hole 1075 for several "closed" positions of the door 1010. The small spring in the bolt takes up the slack that exists in the cable when said bolts are not completely or fully engaged in the receiver holes in the track 1080.

The external portion of the lock 1000 comprises the member 1395 and a pair of side members 1400 and 1410 which are parallel to each other and perpendicular to the members 1395. The external portion 1025 also has a rear wall 1420. The rear wall 1420 is perpendicular to the side member 1395 and the two end members 1400 and 1410. A continuous flange 1440 surrounds the external portion 1025 from passing through a boring 1450 in the door 1010. The flange 1440 bears against the external surface 1017 of the door 1010. The end member 1400 also has extending therefrom a tongue 1450 which intersects a shoulder 1460 which is an integral part of an end member 1470 of the internal portion 1020. The member 1450 has a width which is approximately one-half the width of the member 1470. A tongue member 1480 which is an integral part of the member 1470 also has a width which is one-half the width of the member 1470. The two members 1450 and 1480 are positioned adjacent to one another when the internal portion of the lock 1020 and the external portion of the lock 1025 are installed on the door 1010. A corresponding pair of tongues 1490 and 1500 is associated with the end member 1410 and an end member 1510, respectively. The end members 1470 and 1510 are substantially perpendicular to the rear plate 1520 of the internal portion 1020 of the lock 1000. The plate 1520 has a pair of flanges 1530 and 1540 which bear against the internal surface 1015 of the door 1010 when the internal portion of the lock 1020 is positioned with respect to the external portion of the lock 1025 and rivets such as the rivets 1027 and 1028 are installed in the two sections to hold them together.

With the present embodiment, the door 1010 when in locked position, may be opened by the driver from inside by reaching through the opening 1030 and pulling on the cable 1060 to retract the bolts such as the bolt 1140.

As the housing 648 is rotated due to the handle 644 being moved from the unlocked position 658 into the locked position as disclosed in FIG. 10, the housing 648 moves linearly toward the door 634 thereby exerting an additional closing force upon the door. With respect to FIG. 13 and FIG. 15, as the door 634 is closed, the spring biased bolts 654 or 758, respectively, slide down the inclined surfaces 696 or 754 of the receivers 642 or 752. This axial motion compresses the coil biasing springs 734 and 794, respectively, so that when the bolt end 698 or the inclined surface 760 of the cap 756 enters the retaining region 716 or 796 of the associated receiver 642 or 752 the respective spring biased bolts 634 and 770 move axially under the force of the compressed springs 734 or 794 to bear against the respective surfaces 720 and 798 of the receivers 642 and 752 thereby latching the door 634 closed. With respect to FIG. 2 and FIG. 23, the presence of the stepped bolt ends 830 or 1197 which engage the hole in track 878 or 1080, provides the benefit that the respective doors 802 or 1010 may be closed for intermediate extents against a weather stripping such as the weather stripping 893 and need only to be forced to one close position to insure that the lock mechanism such as the lock mechanism 798 will hold the door closed.

Although various modification might be suggested by those skilled in the art, it should be understood that I wish to embody within the scope of the patent warranted hereon all such modifications as reasonably and properly come within the scope of my contribution to the art.

I claim as my invention:

1. A self-latching, semi-automatic door lock and opener for a door slidably moveable relative to a door frame comprising, a pair of spring biased bolts attached to opposite sides of the door, a pair of bolt receiving means attached to opposite sides of the door frame and positioned to receive said bolts when said door is closed, a single cable extending between and attached to said bolts, guide means attached to said door and said cable passing therethrough, a recess formed in said door through which said cable passes, a handle cover member pivotally attached to said door so that it closes said recess when said handle-cover member is closed and said handle cover member pivotally mounted on a pivot shaft which is attached to said door and extends in the same direction of said cable, a hook attached to said handle cover member and said cable engaged by said hook within said recess, a locking pin attached to said door, and a female locking member attached to said handle cover member and engageable with said locking pin to lock said handle cover member to said door.

* * * * *